US007193550B2

(12) United States Patent
Yamaguchi et al.

(10) Patent No.: US 7,193,550 B2
(45) Date of Patent: Mar. 20, 2007

(54) DRIVING CIRCUIT OF FLAT DISPLAY DEVICE, AND FLAT DISPLAY DEVICE

(75) Inventors: Masanori Yamaguchi, Tokyo (JP); Yasuo Yamada, Tokyo (JP)

(73) Assignee: Sony Corporation (JP)

( * ) Notice: Subject to any disclaimer, the term of this patent is extended or adjusted under 35 U.S.C. 154(b) by 221 days.

(21) Appl. No.: 11/091,434

(22) Filed: Mar. 29, 2005

(65) Prior Publication Data

US 2005/0231409 A1 Oct. 20, 2005

(30) Foreign Application Priority Data

Mar. 30, 2004 (JP) ..... P2004-099123

(51) Int. Cl.
*H03M 1/66* (2006.01)

(52) U.S. Cl. ..... 341/144; 345/213; 345/211; 345/98; 345/87; 345/690

(58) Field of Classification Search ..... 341/144, 341/112; 345/213, 690, 211, 98, 87
See application file for complete search history.

(56) References Cited

U.S. PATENT DOCUMENTS 6,750,839 B1 * 6/2004 Hogan ..... 345/98
2002/0063674 A1 * 5/2002 Chiang ..... 345/98
2002/0158834 A1 * 10/2002 Blankenship et al. ..... 345/100
2004/0189574 A1 * 9/2004 Lee et al. ..... 345/95
2004/0212574 A1 * 10/2004 Iwasaki ..... 345/87

FOREIGN PATENT DOCUMENTS

JP 10-333648 12/1998

* cited by examiner

*Primary Examiner*—Jean Bruner Jeanglaude
(74) *Attorney, Agent, or Firm*—Rader, Fishman & Grauer PLLC; Ronald P. Kananen

(57) ABSTRACT

The present invention provides a driving circuit of a flat display device and a flat display device, and it is applicable, for example, to a display device using organic EL (Electro Luminescence) elements. The present invention makes it possible to correct light emission characteristics variously, effectively avoid significant degradation in image quality due to noise, and further simplify an adjustment operation by generating original reference voltages by selecting a plurality of candidate voltages formed by voltage divider circuits according to original reference voltage setting data, generating reference voltages for digital-to-analog conversion from the original reference voltages, generating the reference voltages at both ends by dividing a reference voltage generating voltage by the voltage divider circuit, and generating the other original reference voltages with voltage divider circuits connected in series with each other and the reference voltages at both ends used as a reference.

6 Claims, 13 Drawing Sheets

DRIVING CIRCUIT OF FLAT DISPLAY DEVICE, AND FLAT DISPLAY DEVICE

BACKGROUND OF THE INVENTION

The present invention relates to a driving circuit of a flat display device and a flat display device, and it is applicable, for example, to a display device using organic EL (Electro Luminescence) elements. The present invention makes it possible to correct light emission characteristics variously, effectively avoid significant degradation in image quality due to noise, and further simplify an adjustment operation by generating original reference voltages by selecting a plurality of candidate voltages formed by voltage divider circuits according to original reference voltage setting data, generating reference voltages for digital-to-analog conversion from the original reference voltages, generating the reference voltages at both ends by dividing a reference voltage generating voltage by the voltage divider circuit, and generating the other original reference voltages with voltage divider circuits connected in series with each other and the reference voltages at both ends used as a reference.

Conventionally, a liquid crystal display device as one type of flat display device changes gamma characteristics by the setting of reference voltages used for digital-to-analog conversion processing, as disclosed in Japanese Patent Laid-Open No. Hei 10-333648, for example.

Specifically, as shown in FIG. 8, the liquid crystal display device 1 has pixels (P) 3R, 3G, and 3B each formed by a liquid crystal cell, a switching device for the liquid crystal cell, a storage capacitor, and a display unit 2 formed by arranging the pixels 3R, 3G, and 3B in the form of a matrix. Each of the pixels 3R, 3G, and 3B in the display unit 2 of the liquid crystal display device 1 is connected to a horizontal driving circuit 4 and a vertical driving circuit 5 via a signal line (column line) SIG and a gate line (row line) G. The vertical driving circuit 5 sequentially selects the pixels 3R, 3G, and 3B, and gradation levels of the pixels 3R, 3G, and 3B are set by driving signals from the horizontal driving circuit 4, whereby a desired image is displayed. The pixels 3R, 3G, and 3B provided with red, green, and blue color filters, respectively, are arranged sequentially and cyclically so that a color image can be displayed.

For this, the liquid crystal display device 1 inputs red, green, and blue image data DR, DG, and DB to be used for display in parallel from a device main unit 6 to a controller 7. The vertical driving circuit 5 drives the gate lines G of the display unit 2 by a timing signal synchronous with the image data DR, DG, and DB. Image data D1 for one system is generated by time-division-multiplexing the image data DR, DG, and DB so as to correspond to driving of the signal lines SIG by the horizontal driving circuit 4, and the signal lines SIG are driven by the horizontal driving circuit 4 on the basis of the image data D1.

FIG. 9 is a block diagram showing in detail the horizontal driving circuit 4 and the controller 7 in conjunction with a related configuration. The controller 7 sequentially stores the image data DR, DG, and DB output from the device main unit 6 in a memory 10 and outputs the image data by control of a memory control circuit 9. The controller 7 thereby time-division-multiplexes the image data DR, DG, and DB such that image data for the same color is contiguous in a line unit with a horizontal scanning period as a unit so as to correspond to the driving of the signal lines SIG by the horizontal driving circuit 4, and then it outputs the time-division-multiplexed image data D1 for one system. Specifically, as to the pixels 3R, 3G, and 3B in this example, the horizontal driving circuit 4 drives the red pixels 3R, the green pixels 3G, and the blue pixels 3B sequentially in a line unit. Thus, as shown in FIG. 10B, the controller 7 outputs the image data D1 so as to repeat the red image data DR, the green image data DG, and the blue image data DB sequentially and cyclically in a line unit.

A timing generator (TG) 11 in the controller 7 generates various timing signals synchronous with the image data D1, and outputs the timing signals to the horizontal driving circuit 4 and the vertical driving circuit 5. Incidentally, the timing signals in this case include, for example, a clock CK (FIG. 10A) of the image data D1, start pulses ST (FIG. 10C) indicating timing of starts and ends of the image data DR, DG, and DB for the respective colors in the image data D1, and strobe pulses (FIG. 10D).

Also, the controller 7 generates original reference voltages VRT, VB to VG, and VRB as a reference for generating reference voltages used for digital-to-analog conversion processing by an original reference voltage generating circuit 12, and then it outputs the original reference voltages VRT, VB to VG, and VRB to the horizontal driving circuit 4.

The horizontal driving circuit 4 inputs the image data D1 output from the controller 7 into a shift register 13, and then it sequentially distributes and outputs the image data D1 to signal line systems of the display unit 2. A reference voltage generating circuit 14 generates reference voltages V1 to V64 as voltages corresponding to gradation levels of the image data D1 from the original reference voltages VRT, VB to VG, and VRB input from the controller 7, and then it outputs the reference voltages V1 to V64.

Digital-to-analog converter circuits (D/A) 15A to 15N each subject output data from the shift register 13 to digital-to-analog conversion processing. Thus, in this example, the digital-to-analog converter circuits 15A to 15N output a driving signal formed by time-division-multiplexing driving signals for three signal lines SIG adjacent to each other. The digital-to-analog converter circuits 15A to 15N perform the digital-to-analog conversion processing on the image data output from the shift register 13 by selecting and outputting the reference voltages V1 to V64 generated by the reference voltage generating circuit 14 according to the output data from the shift register 13.

Amplifier circuits 16A to 16N amplify output signals from the digital-to-analog converter circuits 15A to 15N, respectively, and then output the output signals to the display unit 2. Selectors 17A to 17N in the display unit 2 sequentially and cyclically output the output signals of the amplifier circuits 16A to 16N, respectively, to signal lines SIG for red, green, and blue pixels 3R, 3G, and 3B.

Thus, the driving signal for each signal line SIG is generated by selecting the reference voltages V1 to V64 generated from the original reference voltages VRT, VB to VG, and VRB. FIG. 11 is a block diagram showing a configuration of the original reference voltage generating circuit 12 used to generate the original reference voltages VRT, VB to VG, and VRB and the reference voltage generating circuit 14 used to generate the reference voltages V1 to V64.

The original reference voltage generating circuit 12 has a voltage divider circuit 21 formed by connecting a predetermined number of resistances in series with each other. The voltage divider circuit 21 divides a reference voltage generating voltage VCOM to thereby generate the original reference voltages VRT, VB to VG, and VRB. The original reference voltage generating circuit 12 thus generates the original reference voltages VRT, VB to VG, and VRB by resistance voltage division, and then outputs the original reference voltages VRT, VB to VG, and VRB via amplifier circuits 24A to 24H, respectively. Incidentally, the original reference voltage generating circuit 12 is configured to be able to change voltage applied to the voltage divider circuit 21 by means of a selecting circuit 22 and an inverting amplifier circuit 23 to thereby deal with line reversal or frame reversal. FIG. 10F shows the potential of signal lines SIG in the case of line reversal.

On the other hand, the reference voltage generating circuit 14 has a resistance series circuit 26 formed by connecting voltage divider circuits R1 to R7 in series with each other, the voltage divider circuits R1 to R7 each being formed by connecting a predetermined number of resistances having an equal resistance value in series with each other. The original reference voltages VRT, VB to VG, and VRB are input to one end of the resistance series circuit 26, points of connection between the voltage divider circuits R1 to R7 constituting the resistance series circuit 26, and another end of the resistance series circuit 26 via amplifier circuits 27A to 27H, respectively. Hence, the reference voltage generating circuit 14 further divides potential differences of the original reference voltages VRT, VB to VG, and VRB generated by the original reference voltage generating circuit 12 by the voltage divider circuits R1 to R7, respectively, and thereby generates reference voltages V1 to V64 in a range between the original reference voltages VRT and VRB.

Thus, the numbers of resistances constituting the voltage divider circuits R1 to R7 in the reference voltage generating circuit 14 are each set to a predetermined number so as to generate the reference voltages V1 to V64 from the original reference voltages VRT, VB to VG, and VRB. Thereby, the reference voltage generating circuit 14 can output the plurality of reference voltages V1 to V64 corresponding to gradation levels of the image data D1 by dividing the original reference voltages VRT, VB to VG, and VRB.

In the original reference voltage generating circuit 12, values of the resistances constituting the voltage divider circuit 21 are set so as to display an image with a desired gamma characteristic by using the reference voltages V1 to V64 thus corresponding to the gradation levels of the image data D1. Thereby, as indicated by a reference L1 in FIG. 12, in an example in which the voltage VCOM is set at 5 [V], a desired gamma characteristic is secured by line graph approximation by setting the original reference voltages VRT, VB to VG, and VRB. In addition, the original reference voltage generating circuit 12 allows the original reference voltages VRT, VB to VG, and VRB output from the voltage divider circuit 21 to be changed by altering a wiring pattern. Thus, as indicated by a reference L2 for comparison with the characteristic indicated by the reference L1, in a state in which the original reference voltages VRT and VRB as potentials at both ends are fixed, for example, the gamma characteristic can be varied variously by changing the other original reference voltages VB to VG in ranges indicated by arrows.

Thus, the gamma characteristic can be changed by the setting of the original reference voltage generating circuit 12 for generating the original reference voltages VRT, VB to VG, and VRB. In the liquid crystal display device 1, the controller 7 including the original reference voltage generating circuit 12 is formed by a control IC, while the horizontal driving circuit 4 is formed by a driver IC. Thus, conventionally, a product with a different gamma characteristic can be produced by replacing only the control IC of the liquid crystal display device 1, and thereby in correcting the gamma characteristic, the period of time required for the correction can be shortened. Incidentally, references CA to CH denote stray capacitances between these ICs.

Such flat display devices include a display device formed by organic EL elements. A method has been proposed which sets a gradation level of each organic EL element by driving a signal line SIG in a display unit of such a display device formed by organic EL elements as in the display unit of the liquid crystal display device. Thus, as to the display unit of organic EL elements in such a method, it is conceivable that the control IC and the like in the liquid crystal display device can be used to form the display device.

However, since light emission characteristics of the organic EL elements differ for each color and each product, and the light emission characteristics change with the passage of time, the settings of reference voltages V1 to V64 need to be varied to deal with the difference and change of the light emission characteristics. Therefore, in practice, the display device cannot be formed with the driving circuit of the liquid crystal display device described above with reference to FIG. 8. Specifically, the organic EL elements require black level adjustment and dynamic range adjustment for each color and each product. Incidentally, it is known that the organic EL elements do not require adjustment of a gamma characteristic itself. Therefore, when the original reference voltage generating circuit 12 shown in FIG. 11 is applied, voltages at both ends of the voltage divider circuit 21 need to be adjusted for each color and each product.

One conceivable method for solving this problem is to form an original reference voltage generating circuit as shown in FIG. 13, for example. Specifically, in the original reference voltage generating circuit 30, digital-to-analog converter circuits (D/A) 31A to 31H respectively generate original reference voltages VRT, VB to VG, and VRB according to original reference voltage setting data DV. In this case, the digital-to-analog converter circuits 31A to 31H are formed in the same manner. The digital-to-analog converter circuits 31A to 31H generate a plurality of candidate voltages for the original reference voltages by dividing a reference voltage generating voltage VCOM by a voltage divider circuit 32. A selector 33 selects and outputs the plurality of candidate voltages output from the voltage divider circuit 32 according to the original reference voltage setting data DV.

It is thus possible to set the original reference voltage setting data DV for each color and thereby deal with light emission characteristics different for each color. It is also possible to set the original reference voltage setting data DV for each product and thereby correct variations in the light emission characteristics of the product. In addition, it is possible to deal with change in the light emission characteristics with the passage of time.

With the configuration shown in FIG. 13, however, as shown in FIG. 14, each of the original reference voltages VRT, VB to VG, and VRB can be varied in a range of 0 to VCOM [V]. Hence, when the original reference voltage setting data DV is set erroneously due to noise, the original reference voltages VRT, VB to VG, and VRB are changed in an extreme manner as shown in FIG. 15, for example, thereby degrading image quality significantly.

In addition, in correcting light emission characteristics of such organic EL elements, the organic EL elements with high luminous efficiency require the original reference voltages VB to VG, and VRB to be set so as to suppress a dynamic range of driving signals with respect to the original reference voltage VRT as shown in FIG. 16, in contrast to FIG. 14. In such a case, the configuration shown in FIG. 13 requires resetting of the original reference voltage setting data DV by recalculating the original reference voltages VB to VG of the digital-to-analog converter circuits 31B to 31G so as to correspond to a change in the original reference voltage VRB corresponding to the white level obtained by the lowest voltage. On the other hand, organic EL elements with poor luminous efficiency require the dynamic range to be set so as to be extended. Also, in this case, it is necessary to reset the original reference voltage setting data DV by recalculating the original reference voltages VB to VG so as to correspond to a change in the original reference voltage VRB. Thus, the calculation of the original reference voltages VB to VG is complicated in the adjustment operation at the time of shipment from a factory, for example. Incidentally, black level adjustment also requires the original reference voltages VB to VG of the digital-to-analog converter circuits 31B to 31G to be recalculated so as to correspond to a change in the highest original reference voltage VRT, thus making these calculation operations considerably complicated.

SUMMARY OF THE INVENTION

The present invention has been made in view of the above, and it is an object of the present invention to propose a driving circuit of a flat display device, and a flat display device using the driving circuit that make it possible to correct light emission characteristics variously, effectively avoid significant degradation in image quality due to noise, and further simplify an adjustment operation.

In order to solve the problem, according to an aspect of the present invention, there is provided a driving circuit of a flat display device, the driving circuit generating driving signals by subjecting image data to digital-to-analog conversion processing, and driving signal lines of a display unit formed by arranging pixels in a form of a matrix by the driving signals, the driving circuit including: an original reference voltage generating circuit for generating a plurality of original reference voltages; a reference voltage generating circuit formed by connecting a plurality of voltage divider circuits in series with each other, the voltage divider circuits being each formed by connecting a plurality of resistances in series with each other, the original reference voltages being inputted to both ends of the voltage divider circuits and between the voltage divider circuits, respectively, the reference voltage generating circuit outputting a plurality of reference voltages as voltages divided by the plurality of voltage divider circuits; a plurality of selecting circuits for outputting the driving signals by receiving the plurality of reference voltages and selecting and outputting the reference voltages according to the image data for corresponding signal lines; and an input circuit for inputting original reference voltage setting data for specifying settings of the original reference voltages; wherein the original reference voltage generating circuit includes a plurality of digital-to-analog converter circuits for generating the original reference voltages by generating a plurality of candidate voltages for the original reference voltages by voltage divider circuits for generating the original reference voltages and selecting and outputting the candidate voltages according to the original reference voltage setting data; and a first digital-to-analog converter circuit of the plurality of digital-to-analog converter circuits divides a reference voltage generating voltage by a voltage divider circuit for generating the original reference voltage, and outputs a first original reference voltage of the plurality of original reference voltages; a second digital-to-analog converter circuit of the plurality of digital-to-analog converter circuits divides the reference voltage generating voltage by a voltage divider circuit for generating the original reference voltage, and outputs a second original reference voltage of the plurality of original reference voltages; and voltage divider circuits for generating the original reference voltages of the other digital-to-analog converter circuits of the plurality of digital-to-analog converter circuits are connected in series with each other, and the first original reference voltage and the second original reference voltage are input to both ends, respectively, of the other digital-to-analog converter circuits.

With the above-described composition of the driving circuit, it is possible to correct light emission characteristics variously by the original reference voltage setting data. That is, it is possible to correct the light emission characteristics different for different colors by setting the original reference voltage setting data for each color, correct the light emission characteristics varied between products by setting the original reference voltage setting data for each product, and correct change in the light emission characteristics with the passage of time by setting the original reference voltage setting data in such a manner as to correspond to the change in the light emission characteristics.

Moreover, the original reference voltages output by the other digital-to-analog converter circuits can be varied in only ranges of the respective candidate voltages generated by a series connection of the voltage divider circuits for generating the original reference voltages. Thus, even when the original reference voltage setting data is set erroneously due to noise, it is possible to effectively avoid significant change in a gamma characteristic, and thereby prevent significant degradation in image quality due to the noise. In addition, since these original reference voltages change so as to follow change in the first original reference voltage and the second original reference voltage, it is possible to omit a process of resetting the original reference voltages according to the change in the first original reference voltage and the second original reference voltage, and thus simplify an adjustment operation by omitting a calculation process for these other digital-to-analog converter circuits.

According to another aspect of the present invention, there is provided a flat display device for displaying an image on the basis of image data, the flat display device including: a display unit formed by arranging pixels in the form of a matrix; and a horizontal driving circuit for driving signal lines of the display unit by driving signals; wherein the horizontal driving circuit includes: an original reference voltage generating circuit for generating a plurality of original reference voltages; a reference voltage generating circuit formed by connecting a plurality of voltage divider circuits in series with each other, the voltage divider circuits being each formed by connecting a plurality of resistances in series with each other, the original reference voltages being inputted to both ends of the voltage divider circuits and between the voltage divider circuits, respectively, the reference voltage generating circuit outputting a plurality of reference voltages as voltages divided by the plurality of voltage divider circuits; and a plurality of selecting circuits for outputting the driving signals by receiving the plurality of reference voltages and selecting and outputting the reference voltages according to the image data for corresponding signal lines, and wherein the original reference voltage generating circuit includes a plurality of digital-to-analog converter circuits for generating the original reference voltages by generating a plurality of candidate voltages for the original reference voltages by voltage divider circuits for generating the original reference voltages and selecting and outputting the candidate voltages according to original reference voltage setting data, a first digital-to-analog converter circuit of the plurality of digital-to-analog converter circuits dividing a reference voltage generating voltage by a voltage divider circuit for generating the original reference voltage, and outputting a first original reference voltage, a second digital-to-analog converter circuit of the plurality of digital-to-analog converter circuits dividing the reference voltage generating voltage by a voltage divider circuit for generating the original reference voltage, and outputting a second original reference voltage, voltage divider circuits for generating the original reference voltages of the other digital-to-analog converter circuits of the plurality of digital-to-analog converter circuits being connected in series with each other, and the first original reference voltage and the second original reference voltage being input to both ends, respectively, of the other digital-to-analog converter circuits.

With the above-described composition, it is possible to provide a flat display device that makes it possible to set light emission characteristics variously, effectively avoid significant degradation in image quality due to noise, and further simplify an adjustment operation.

According to the present invention, it is possible to provide a driving circuit, and a flat display device using the driving circuit that make it possible to correct light emission characteristics variously, effectively avoid significant degradation in image quality due to noise, and further simplify an adjustment operation.

DETAILED DESCRIPTION OF THE PREFERRED EMBODIMENT

A preferred embodiment of the present invention will hereinafter be described in detail with reference to the drawings as appropriate.

(1) Configuration of Embodiment

Figure 2:
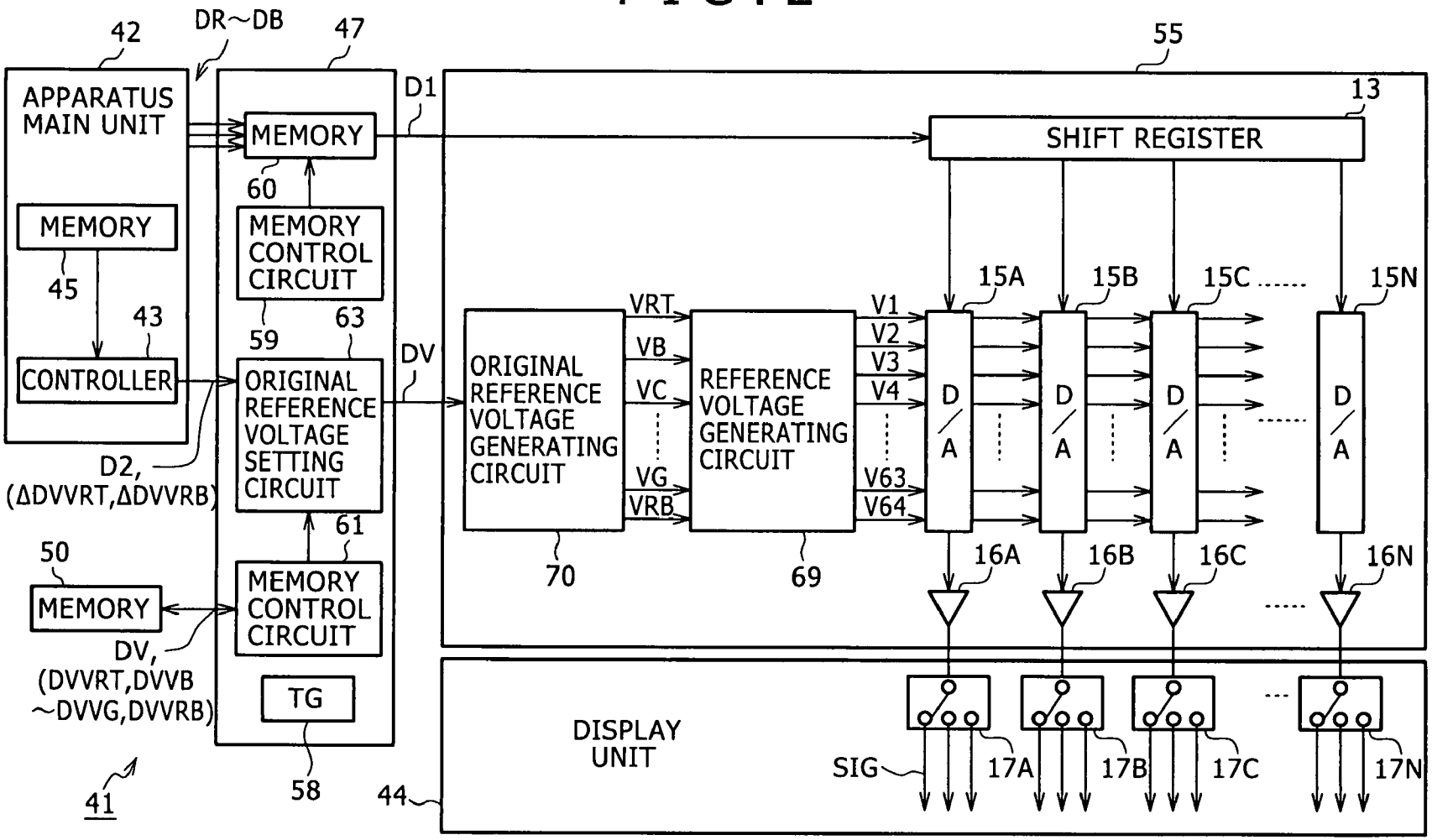
FIG. 2 is a block diagram showing the PDA according to the embodiment of the present invention.
Figure 8:
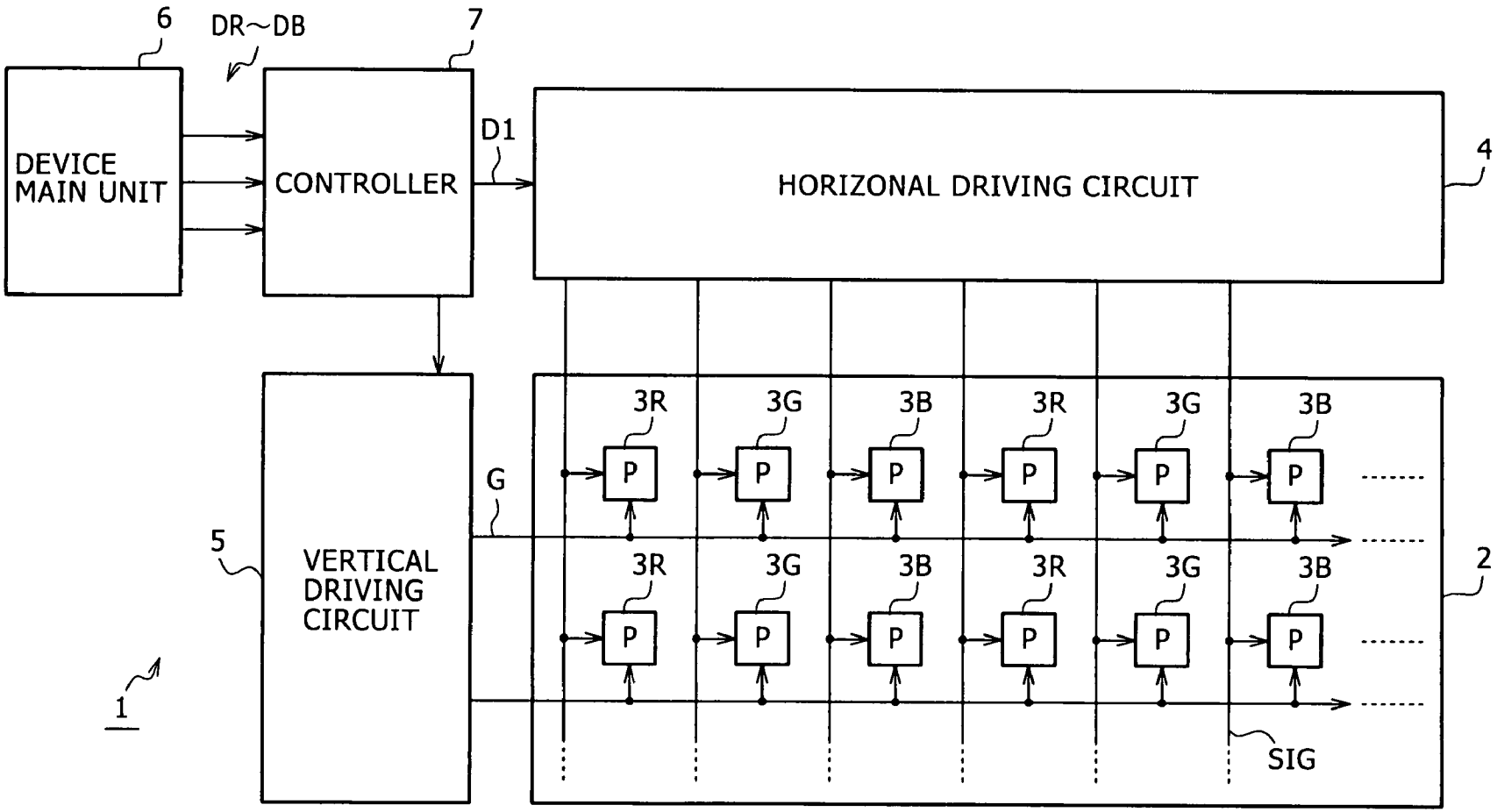
FIG. 8 is a block diagram showing a related-art liquid crystal display device.
Figure 9:
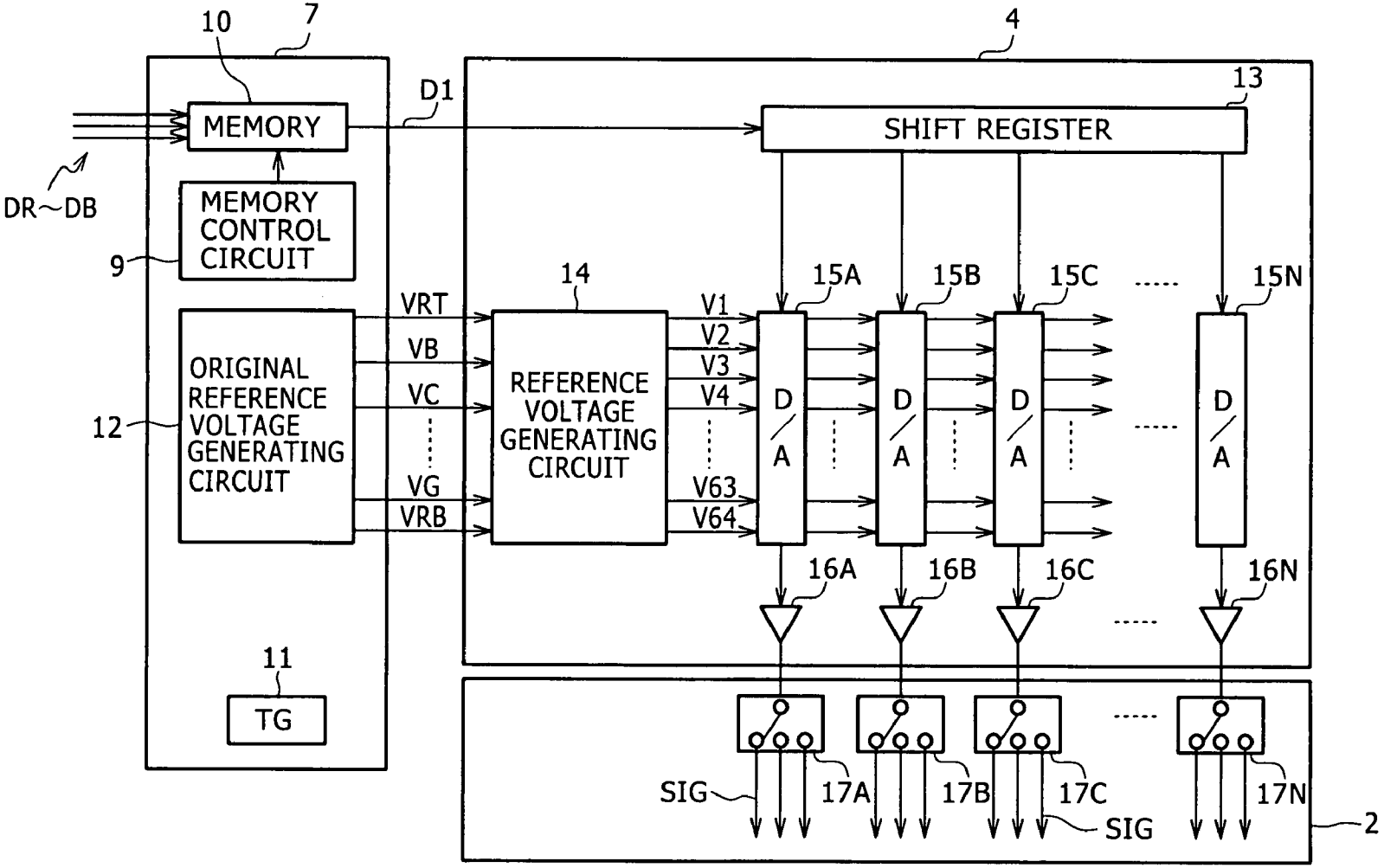
FIG. 9 is a block diagram showing a horizontal driving circuit in the liquid crystal display device of FIG. 8 in conjunction with a peripheral configuration.
Figures 10A, 10B, 10C, 10D, 10E, 10F:
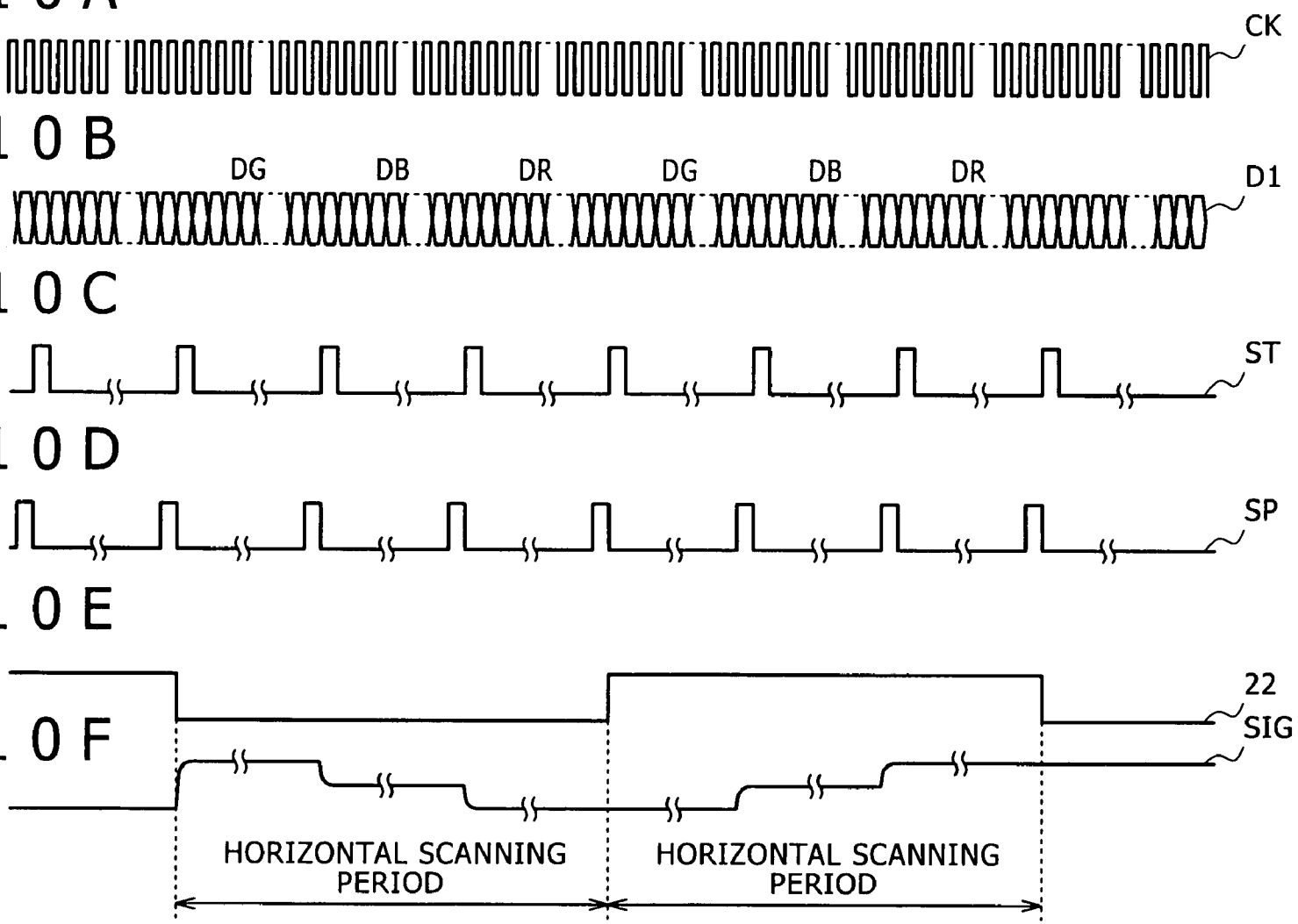
FIGS. 10A, 10B, 10C, 10D, 10E, and 10F are time charts for assistance in explaining FIG. 9.

FIG. 2 is a block diagram showing a PDA (Personal Digital Assistant) according to the embodiment of the present invention. A controller 43 as processing means in an apparatus main unit 42 of the PDA 41 executes a predetermined processing procedure in response to an operation of an operating element to thereby display various images on a display unit 44. Incidentally, in FIG. 2, the same components as in FIG. 8 and FIG. 9 are identified by corresponding reference numerals, and a repeated description thereof will be omitted.

The display unit 44 in the present embodiment is a color image display panel formed by arranging pixels each formed by an organic EL element in a form of a matrix. The display unit 44 selects pixels in a unit of a line by a vertical driving circuit not shown in the figure using a gate line connected to each pixel, and it sets a gradation level of each pixel by driving a signal line SIG.

Figure 11:
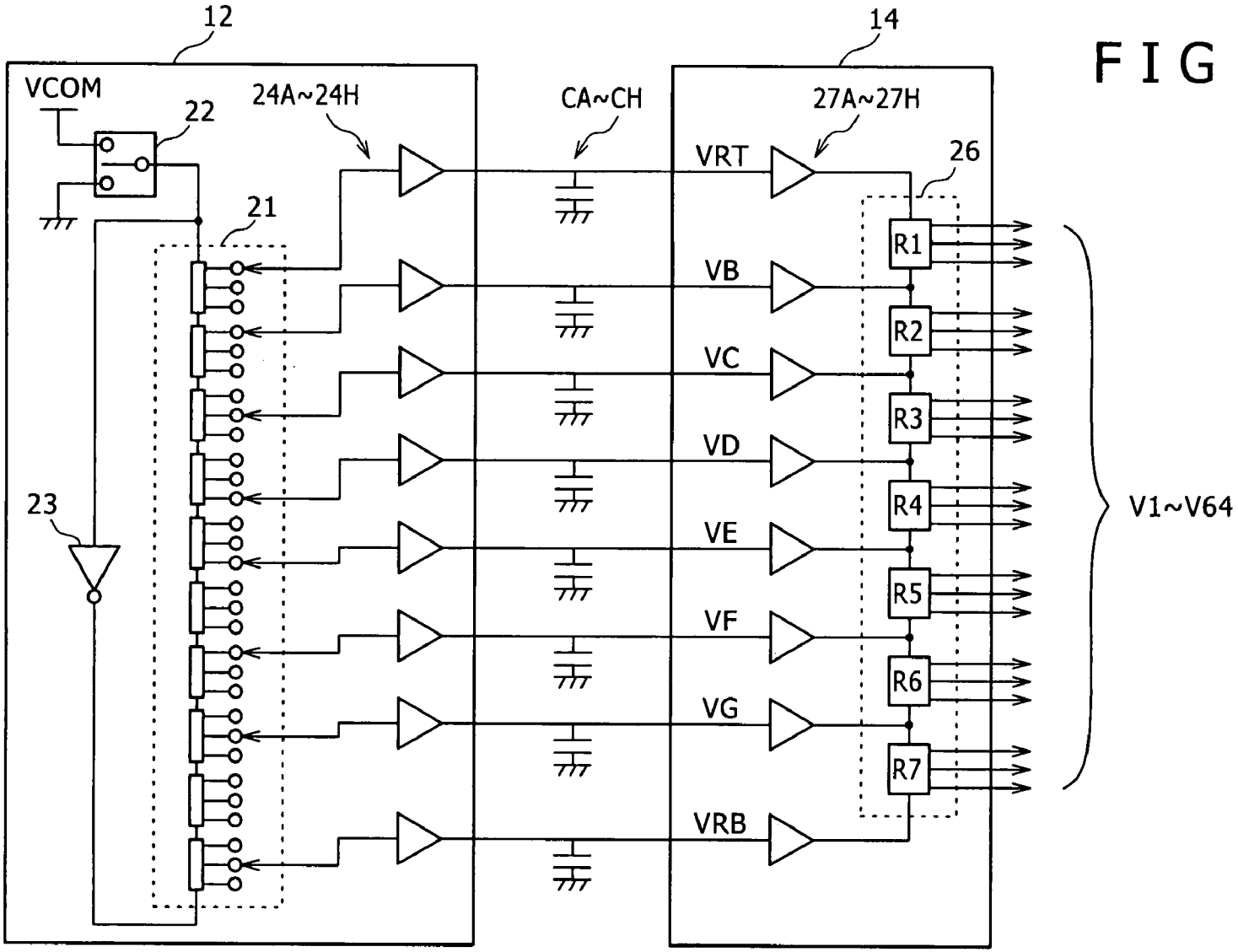
FIG. 11 is a block diagram showing an original reference voltage generating circuit and a reference voltage generating circuit in the horizontal driving circuit and a controller in FIG. 9.
Figure 12:
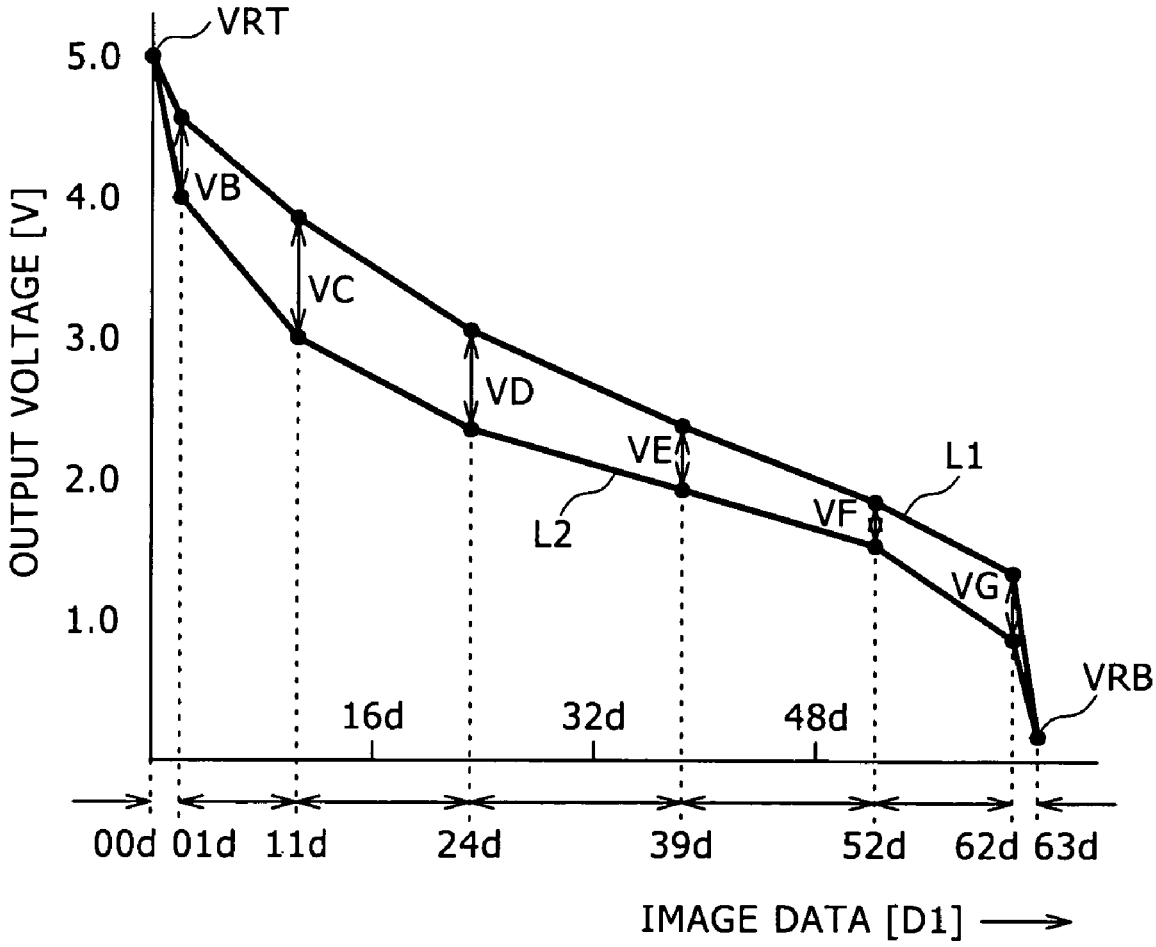
FIG. 12 is a characteristic curve diagram of assistance in explaining a gamma characteristic in the liquid crystal display device of FIG. 8.
Figure 13:
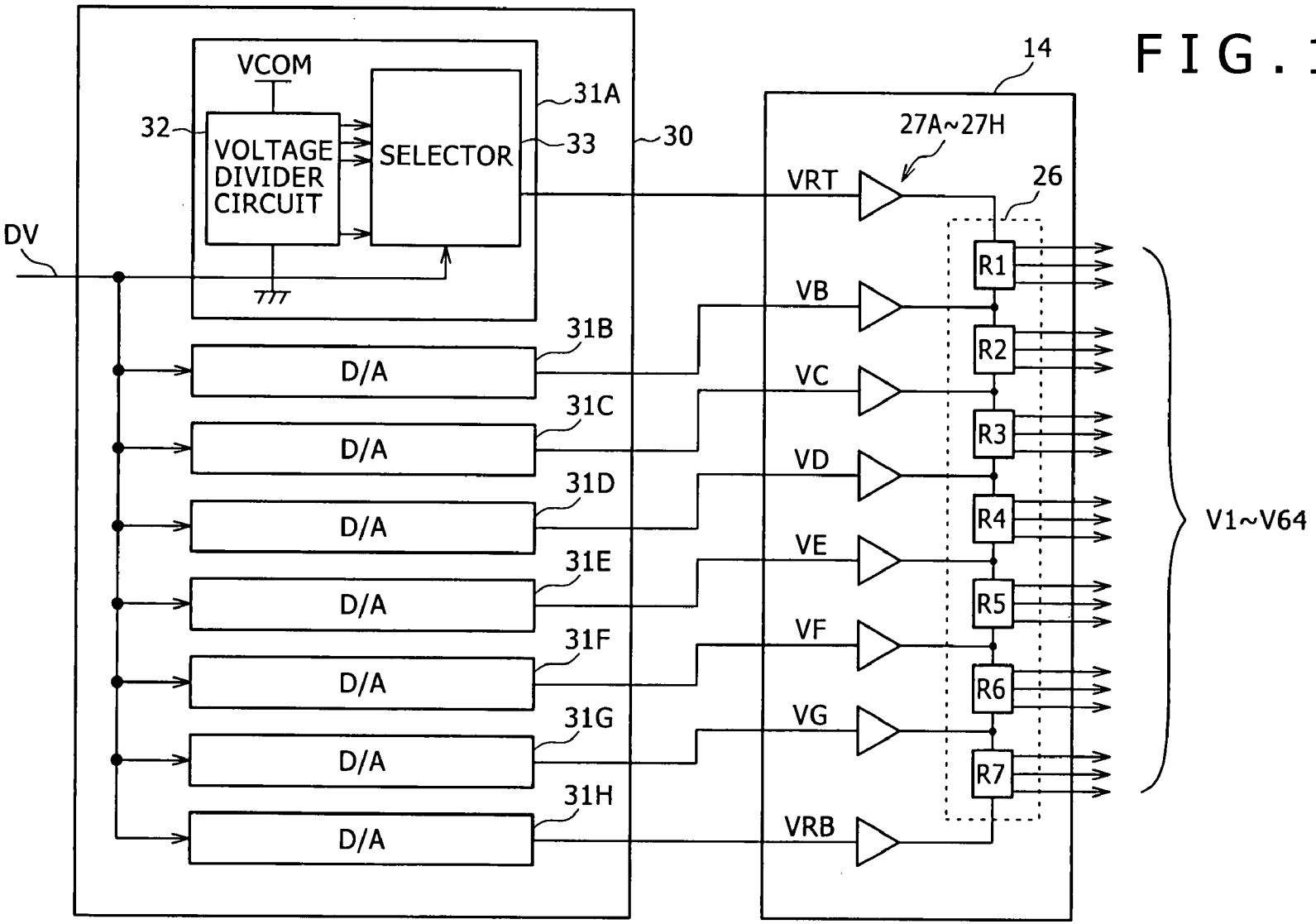
FIG. 13 is a block diagram showing an example of the setting of original reference voltages according to original reference voltage setting data.
Figure 14:
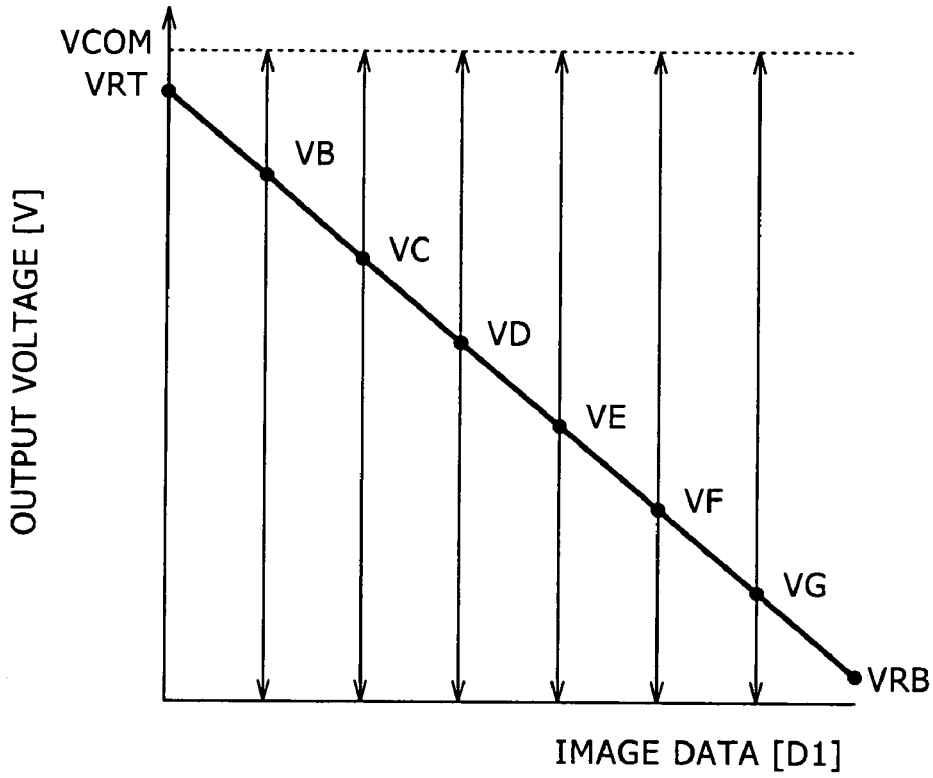
FIG. 14 is a characteristic curve diagram of assistance in explaining a gamma characteristic in the example of FIG. 13.
Figure 15:
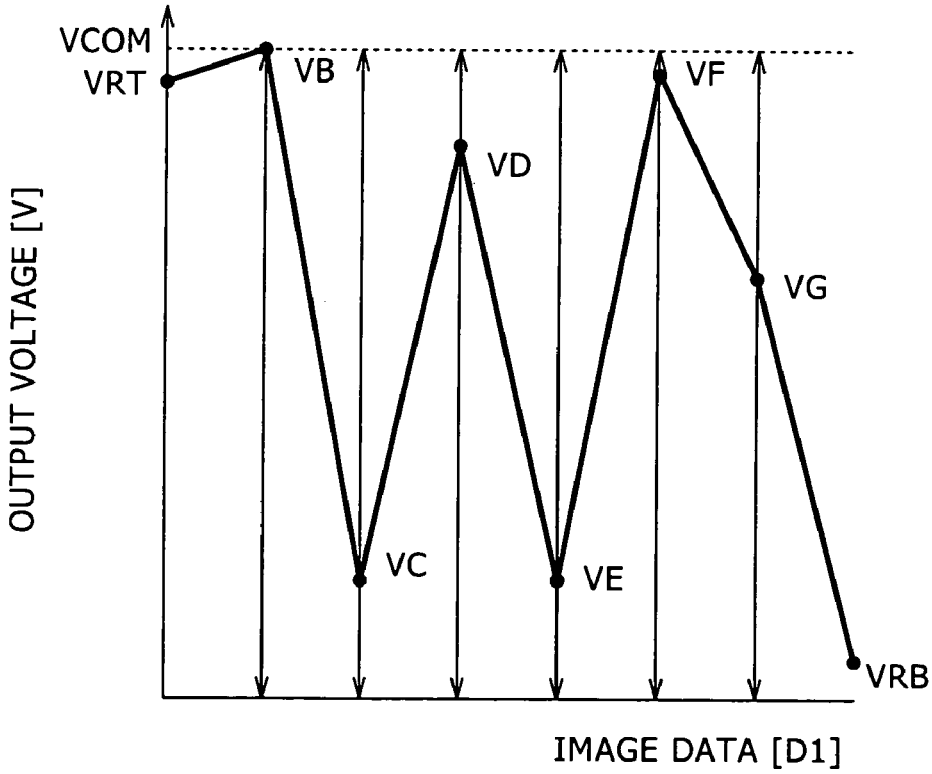
FIG. 15 is a characteristic curve diagram of assistance in explaining the effects of noise in the example of FIG. 13.
Figure 16:
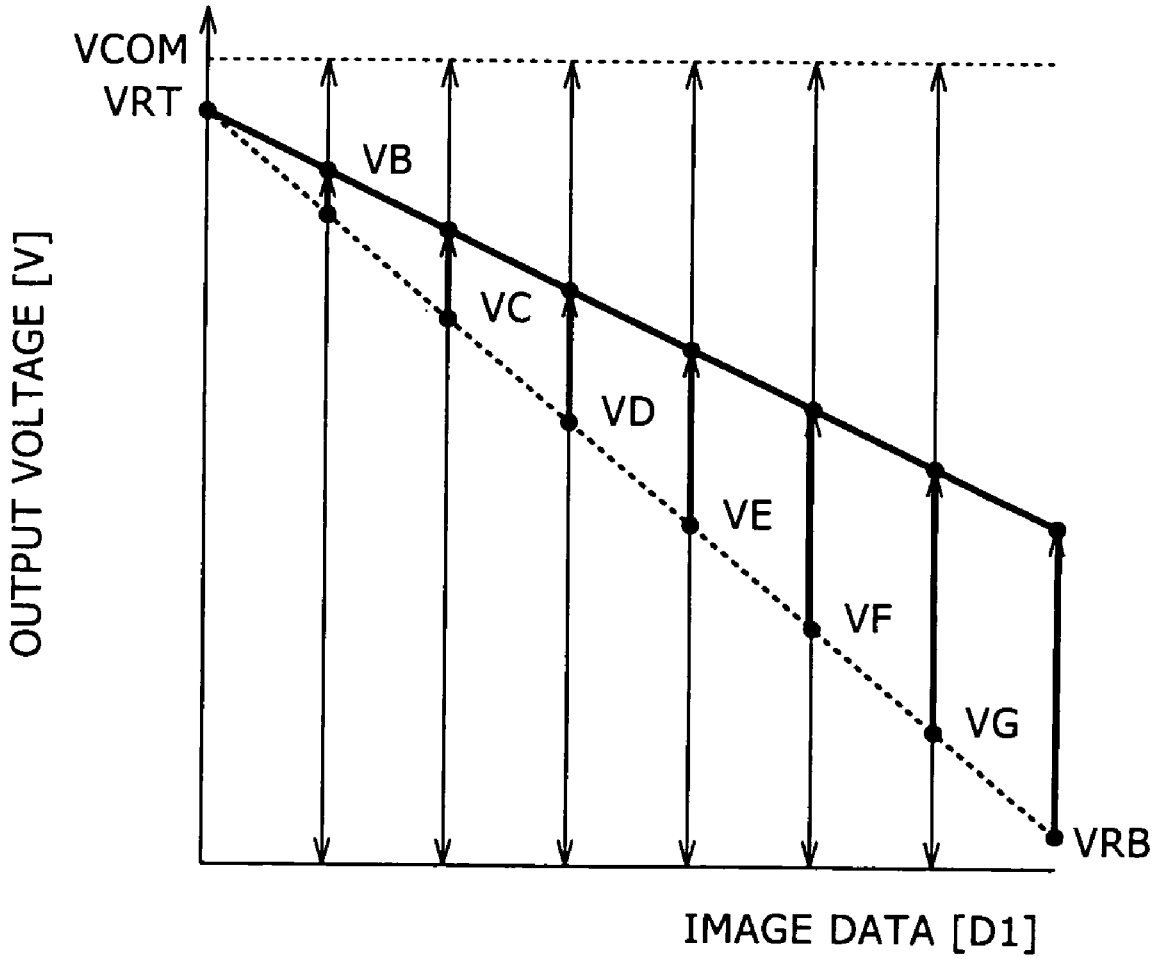
FIG. 16 is a characteristic curve diagram of assistance in explaining dynamic range adjustment in the example of FIG. 13.

At the time of shipment of the PDA 41 from a factory, the characteristics of light emission in each color on the display unit 44 formed by organic EL elements are measured. On the basis of the result of the measurement, original reference voltage setting data DV specifying settings of original reference voltages VRT, VB to VG, and VRB described above with reference to FIG. 11 is recorded in a memory 50. Thus, by using the original reference voltage setting data DV, variations in the characteristics of light emission in each color and variations in the characteristics of light emission between products can be corrected, whereby display images can be displayed with a correct white balance and a correct color reproducibility.

Of the original reference voltages VRT, VB to VG, and VRB in the present embodiment, the highest original reference voltage VRT and the lowest original reference voltage VRB correspond to gradations of a black level and a white level, respectively. The two original reference voltages VRT and VRB hereinafter will be referred to as the black level original reference voltage VRT and the white level original reference voltage VRB, respectively, as appropriate. Correspondingly the original reference voltage setting data DV corresponding to the black level original reference voltage VRT and the white level original reference voltage VRB will be referred to as black level original reference voltage setting data and white level original reference voltage setting data, and identified by references DVVRT and DVVRB, respectively, as appropriate. Correspondingly, the original reference voltage setting data DV for the original reference voltages VB to VG other than the black level original reference voltage VRT and the white level original reference voltage VRB will be identified by references DVVB to DVVG. Thus, the memory 50 retains the black level original reference voltage setting data DVVRT, the white level original reference voltage setting data DVVRB, and the other original reference voltage setting data DVVB to DVVG.

The PDA 41 can adjust the white balance, the black level, and the white level of the display unit 44 by executing a predetermined process procedure by the controller 43 according to a preference of a user and so as to be able to deal with a change in light emission characteristics with the passage of time. A result of the adjustment is recorded and retained in a memory 45, and display of the display unit 44 is set by the result of the adjustment. In the PDA 41, correction data D2 of the black level original reference voltage setting data DVVRT and the white level original reference voltage setting data DVVRB of the original reference voltage setting data DVVRT, DVVB to DVVG, and DVVRB recorded in the memory 50 at the time of shipment from the factory is recorded and retained for each color in the memory 45 in a form of differential data ΔDVVRT and ΔDVVRB corresponding to the original reference voltage setting data DVVRT and DVVRB. The correction data D2 recorded in the memory 45 is output to a controller 47 in timing corresponding to processing of the controller 47. Thus the PDA 41 records and retains the result of adjustment of the white balance and the like, and sets the display of the display unit 44 by the result of adjustment.

The controller 47 is formed by an integrated circuit. The controller 47 time-division-multiplexes image data DR, DG, and DB for each color output from the apparatus main unit 42 in a line unit, and then outputs image data D1 for one system. Also, the controller 47 corrects the original reference voltage setting data DV on the basis of the correction data D2 output from the controller 43 of the apparatus main unit 42, and then outputs the result to a horizontal driving circuit 55.

Specifically, a timing generator (TG) 58 in the controller 47 generates and outputs various timing signals synchronous with the image data D1 and DR to DB. A memory control circuit 59 controls operation of a memory 60 using the timing signal as a reference. The memory 60 time-division-multiplexes the image data DR, DG, and DB in a line unit by sequentially storing and outputting the image data DR to DB output from the apparatus main unit 42, and then outputs the image data D1.

A memory control circuit 61 controls operation of the memory 50 to read the original reference voltage setting data DV from the memory 50 and output the original reference voltage setting data DV to an original reference voltage setting circuit 63 in a horizontal scanning period.

Figure 3:
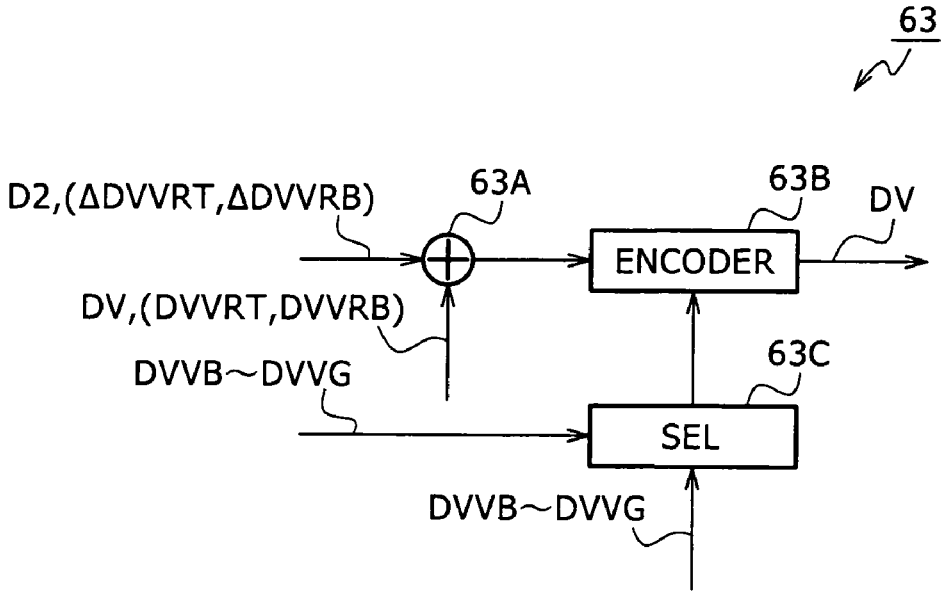
FIG. 3 is a block diagram showing an original reference voltage setting circuit in FIG. 1.

The original reference voltage setting circuit 63 corrects the original reference voltage setting data DV output from the memory control circuit 61 on the basis of the correction data D2 output from the controller 43 of the apparatus main unit 42, and then outputs the corrected original reference voltage setting data DV. Specifically, as shown in FIG. 3, the original reference voltage setting circuit 63 inputs the black level original reference voltage setting data DVVRT and the white level original reference voltage setting data DVVRB of the original reference voltage setting data DV (DVVRT, DVVB to DVVG, and DVVRB) input via the memory control circuit 61 to an adder circuit 63A, where the corresponding correction data D2 (ΔDVVRT and ΔDVVRB) output from the apparatus main unit 42 is added to the black level original reference voltage setting data DVVRT and the white level original reference voltage setting data DVVRB. Thereby the black level original reference voltage setting data DVVRT and the white level original reference voltage setting data DVVRB are corrected. The black level original reference voltage setting data DVVRT and the white level original reference voltage setting data DVVRB thus corrected are input to an encoder 63B, and the other original reference voltage setting data DVVB to DVVG are input to the encoder 63B via a selector (SEL) 63C, where the original reference voltage setting data DVVRT, DVVB to DVVG, and DVVRB are converted into serial data for output. Incidentally, the original reference voltage setting circuit 63 can output original reference voltage setting data separately output from the apparatus main unit 42 in place of the original reference voltage setting data DVVB to DVVG thus output from the memory control circuit 61 by setting the selector 63C.

In this series of processes, the original reference voltage setting circuit 63 generates and outputs the original reference voltage setting data DV so as to correspond to driving of signal lines SIG in the horizontal driving circuit 55. The display unit 44 in the present embodiment combines a red, a green, and a blue pixel contiguous with each other in a horizontal direction into one set, and drives the pixel set by one driving signal on a time division basis. Thus the original reference voltage setting circuit 63 selects and outputs the original reference voltage setting data DV for the image data DR, DG, and DB for red, green, and blue, respectively, in one horizontal scanning period.

The horizontal driving circuit 55 is formed by an integrated circuit separate from the controller 47. The horizontal driving circuit 55 distributes the image data D1 output from the controller 47 to each set of a red, a green, and a blue pixel contiguous with each other in the horizontal direction as described above by a shift register 13, and then subjects the distributed image data D1 to a digital-to-analog conversion process by digital-to-analog converter circuits 15A to 15N formed by a selector. The horizontal driving circuit 55 amplifies driving signals resulting from the digital-to-analog conversion process by amplifier circuits 16A to 16N, respectively, and then outputs the driving signals to the display unit 44. The display unit 44 distributes the output signals of the amplifier circuits 16A to 16N to signal lines SIG by selectors 17A to 17N, respectively.

The horizontal driving circuit 55 generates reference voltages V1 to V64 of the digital-to-analog converter circuits 15A to 15N involved in such a series of processes by an original reference voltage generating circuit 70 and a reference voltage generating circuit 69 according to the original reference voltage setting data DV.

Figure 1:
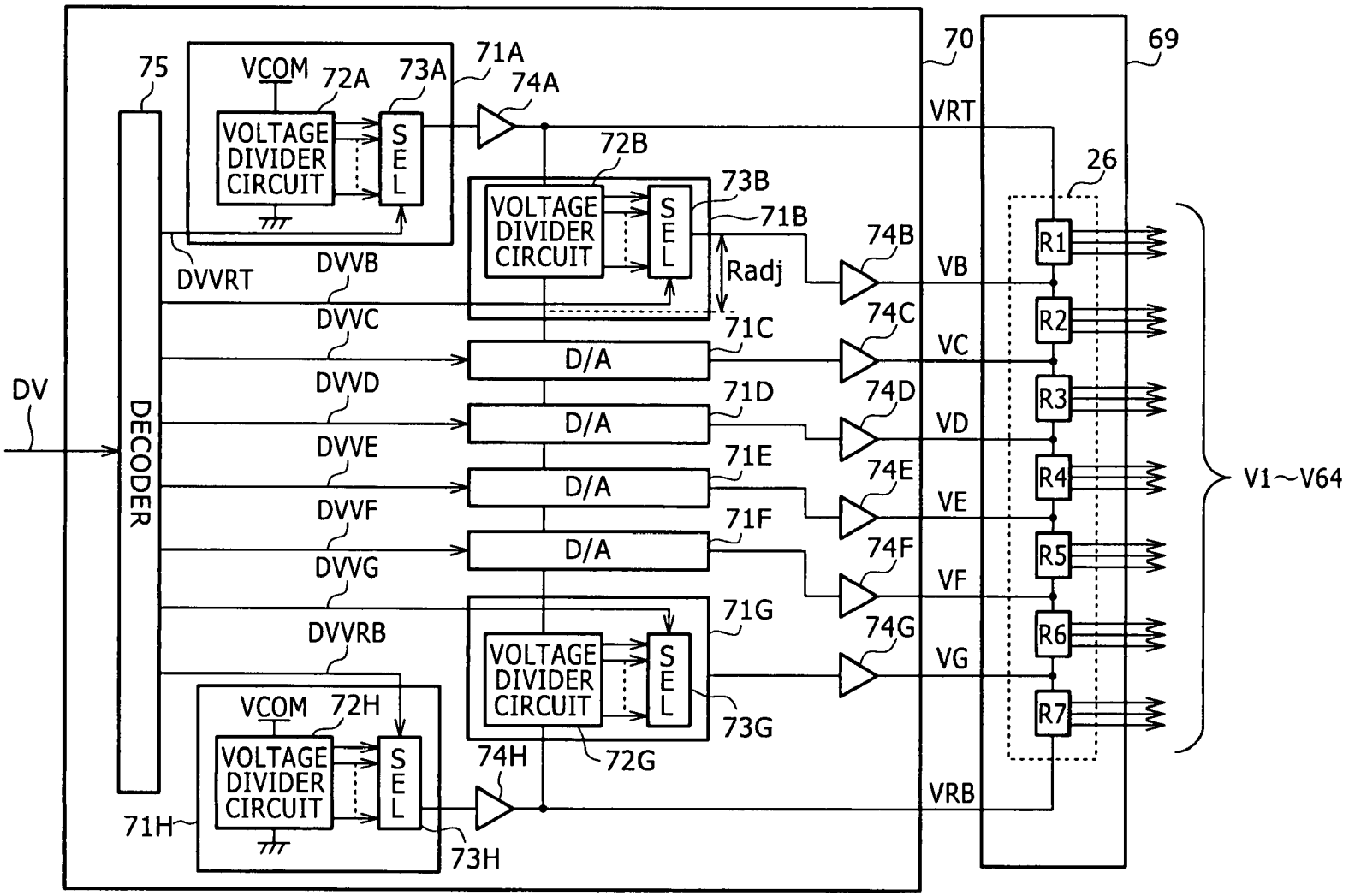
FIG. 1 is a block diagram showing an original reference voltage generating circuit and a reference voltage generating circuit of a PDA according to an embodiment of the present invention.

FIG. 1 is a block diagram showing the original reference voltage generating circuit 70 and the reference voltage generating circuit 69. In this case, the reference voltage generating circuit 69 is formed in the same manner as the reference voltage generating circuit 14 described above with reference to FIG. 11 except that the amplifier circuits 27A to 27H are omitted in the reference voltage generating circuit 69. The reference voltage generating circuit 69 generates the reference voltages V1 to V64 by resistance voltage division from the original reference voltages VRT, VB to VG, and VRB output from the original reference voltage generating circuit 70, and then outputs the reference voltages V1 to V64.

The original reference voltage generating circuit 70 generates the original reference voltages VRT, VB to VG, and VRB by digital-to-analog converter circuits (D/A) 71A to 71H, respectively, according to the original reference voltage setting data DV.

Of the digital-to-analog converter circuits 71A to 71H, the digital-to-analog converter circuits 71A and 71H for generating the black level original reference voltage VRT and the white level original reference voltage VRB each generate a plurality of candidate voltages for the original reference voltage by dividing a reference voltage generating voltage VCOM by voltage divider circuits 72A and 72H. The voltage divider circuits 72A and 72H are formed by a series circuit of a plurality of resistances having an equal resistance value. The voltage divider circuits 72A and 72H divide the reference voltage generating voltage VCOM by a resolution corresponding to the number of bits of the original reference voltage setting data DV, and then outputs the result. In the present embodiment, the original reference voltage setting data DV is formed by six bits, and the reference voltage generating voltage VCOM is set at 5 [V]. Thus, the voltage divider circuits 72A and 72H output 64 candidate voltages that differ from each other in voltage value by a unit of about 80 [mV] (≈5 [V]/64).

Selectors 73A and 73H select and output the 64 candidate voltages output from the voltage divider circuits 72A and 72H, respectively, according to the black level original reference voltage setting data DVVRT and the white level original reference voltage setting data DVVRB, respectively. The selectors 73A and 73H output the black level original reference voltage VRT and the white level original reference voltage VRB thus generated via amplifier circuits 74A and 74H, respectively.

As with the digital-to-analog converter circuits 71A and 71H, the other digital-to-analog converter circuits 71B to 71G than the digital-to-analog converter circuits 71A and 71H respectively generate a plurality of candidate voltages for the original reference voltages VB to VG by resistance voltage division by voltage divider circuits 72B to 72G, select the plurality of candidate voltages by selectors 73B to 73G, respectively, according to the original reference voltage setting data DV, and then output the original reference voltages VB to VG. The voltage divider circuits 72B to 72G of the digital-to-analog converter circuits 71B to 71G, the voltage divider circuits 72B to 72G being used to generate the candidate voltages for the original reference voltages VB to VG, are connected in series with each other between the digital-to-analog converter circuits 71B to 71G, and are connected to the black level original reference voltage VRT and the white level original reference voltage VRB generated by the digital-to-analog converter circuits 71A and 71H.

Figure 4:
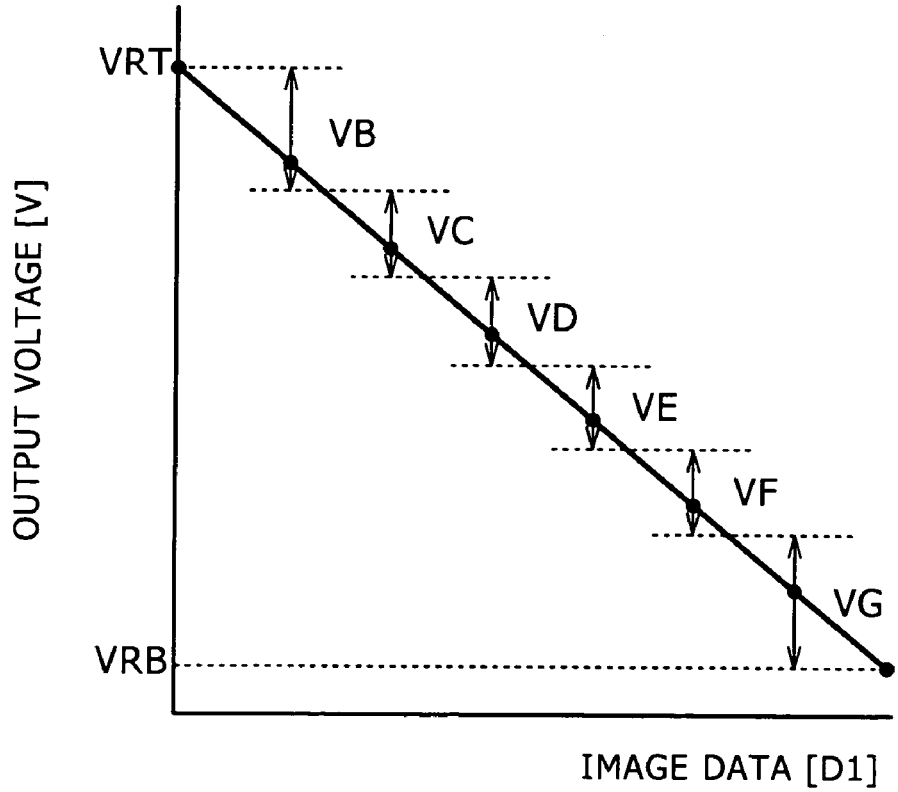
FIG. 4 is a characteristic curve diagram of assistance in explaining a gamma characteristic in the PDA of FIG. 2.
Figure 5:
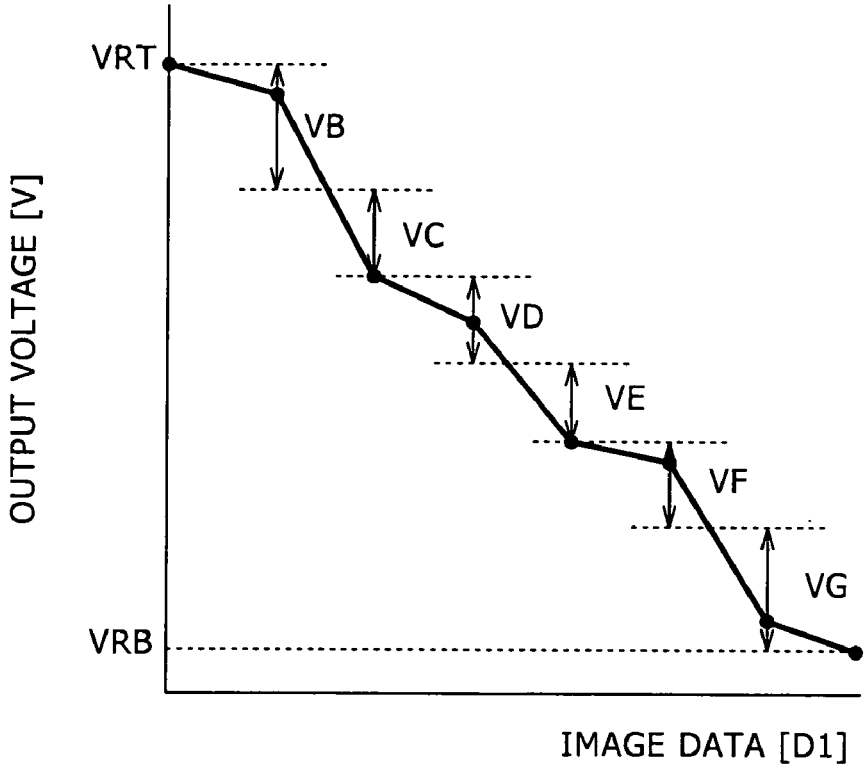
FIG. 5 is a characteristic curve diagram of assistance in explaining the effects of noise in the PDA of FIG. 2.

Hence, as shown in FIG. 4, of the original reference voltages VRT, VB to VG, and VRB, the original reference voltages VB to VG excluding the black level original reference voltage VRT and the white level original reference voltage VRB are varied only in a range of the candidate voltages output from the voltage divider circuits 72B to 72G connected in series with each other. Thus, as shown in FIG. 5 in contrast with FIG. 4, even when the original reference voltage setting data DV is erroneously set due to the mixing in of noise, the PDA 41 can prevent the output of driving signals with extreme gamma characteristics and thereby prevent significant degradation in image quality due to the noise.

Figure 6:
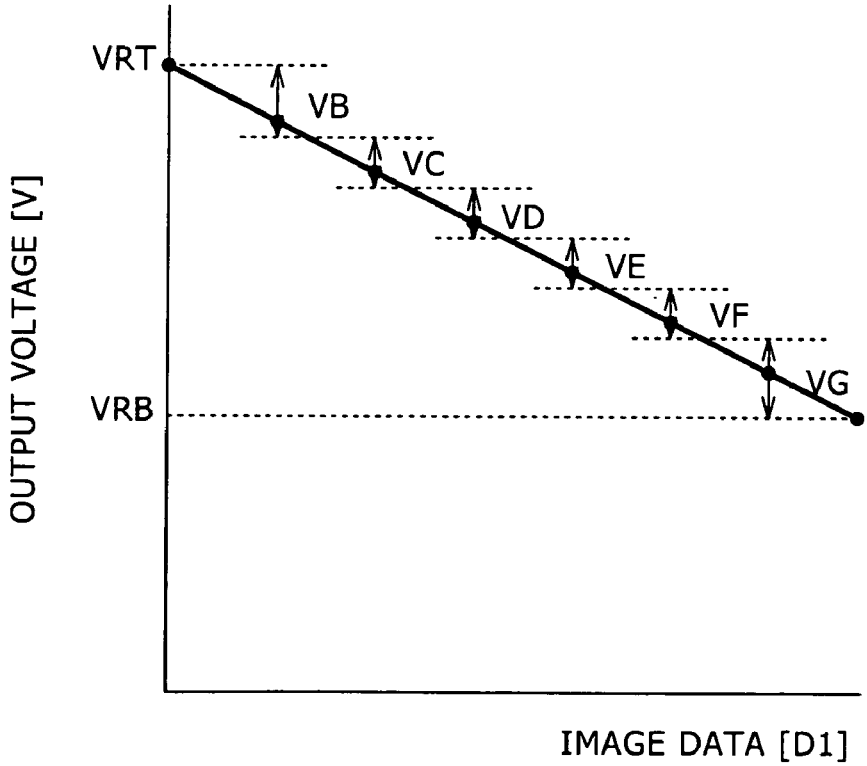
FIG. 6 is a characteristic curve diagram of assistance in explaining dynamic range adjustment in the PDA of FIG. 2.

In addition, since both ends of the voltage divider circuits 72B to 72G thus connected in series with each other are connected to the original reference voltages VRT and VRB as a first original reference voltage and a second original reference voltage, when the original reference voltages VRT and VRB are changed to correct variations in light emission characteristics between colors and variations in light emission characteristics between products by dynamic range adjustment and black level adjustment, the original reference voltages VB to VG also change so as to follow the change in the original reference voltages VRT and VRB by resistance voltage division ratios of the voltage divider circuits 72B to 72G connected in series with each other, as shown in FIG. 6 in contrast with FIG. 4. It is therefore possible to omit a process of resetting the original reference voltages VB to VG, and thus simplify an adjustment operation by omitting a calculation process for these other digital-to-analog converter circuits.

Specifically, letting RB to RG be resistance values of the voltage divider circuits 72B to 72G, the following relations can be obtained for the original reference voltage VB output from the digital-to-analog converter circuit 71B, using the original reference voltages VRT and VRB. In the equations, Radj is a resistance value between a terminal of the voltage divider circuit 72B on the side of the original reference voltage VRB to a terminal for a divided voltage output of the voltage divider circuit 72B which output is selected by the selector 73B as shown in FIG. 1, and A is a coefficient of a desired gamma characteristic.

$$VB = (VRT - VRB) \times A + VRB \tag{1}$$

$$\frac{Radj + RC + RD + RE + RF + RG}{RB + RC + RD + RE + RF + RG} = \frac{VB - VRB}{VRT - VRB} \tag{2}$$

The following equation can be obtained by determining Radj from these relations. It is thereby understood that even when the original reference voltages VRT and VRB are changed, the output of the voltage divider circuit 72B which output is selected by the selector 73B is retained at a position corresponding to the coefficient A of the gamma characteristic and does not require any change.

$$\begin{aligned} Radj &= (RB + RC + RD + RE + RF + RG) \times \\ &\quad \left[\frac{VB - VRB}{VRT - VRB} - \frac{RC + RD + RE + RF + RG}{RB + RC + RD + RE + RF + RG}\right] \\ &= (RB + RC + RD + RE + RF + RG) \times \\ &\quad A - (RC + RD + RE + RF + RG) \end{aligned} \tag{3}$$

The original reference voltage generating circuit 70 outputs the original reference voltages VB to VG output from the digital-to-analog converter circuits 71B to 71G to the reference voltage generating circuit 69 via amplifier circuits 74B to 74G together with the black level original reference voltage VRT and the white level original reference voltage VRB.

A decoder 75 sequentially captures the original reference voltage setting data DV as serial data output from the controller 47. The decoder 75 distributes and outputs the original reference voltage setting data DV to the digital-to-analog converter circuits 71A to 71H in timing corresponding to changing of contacts in the selectors 17A to 17N.

Figure 7:
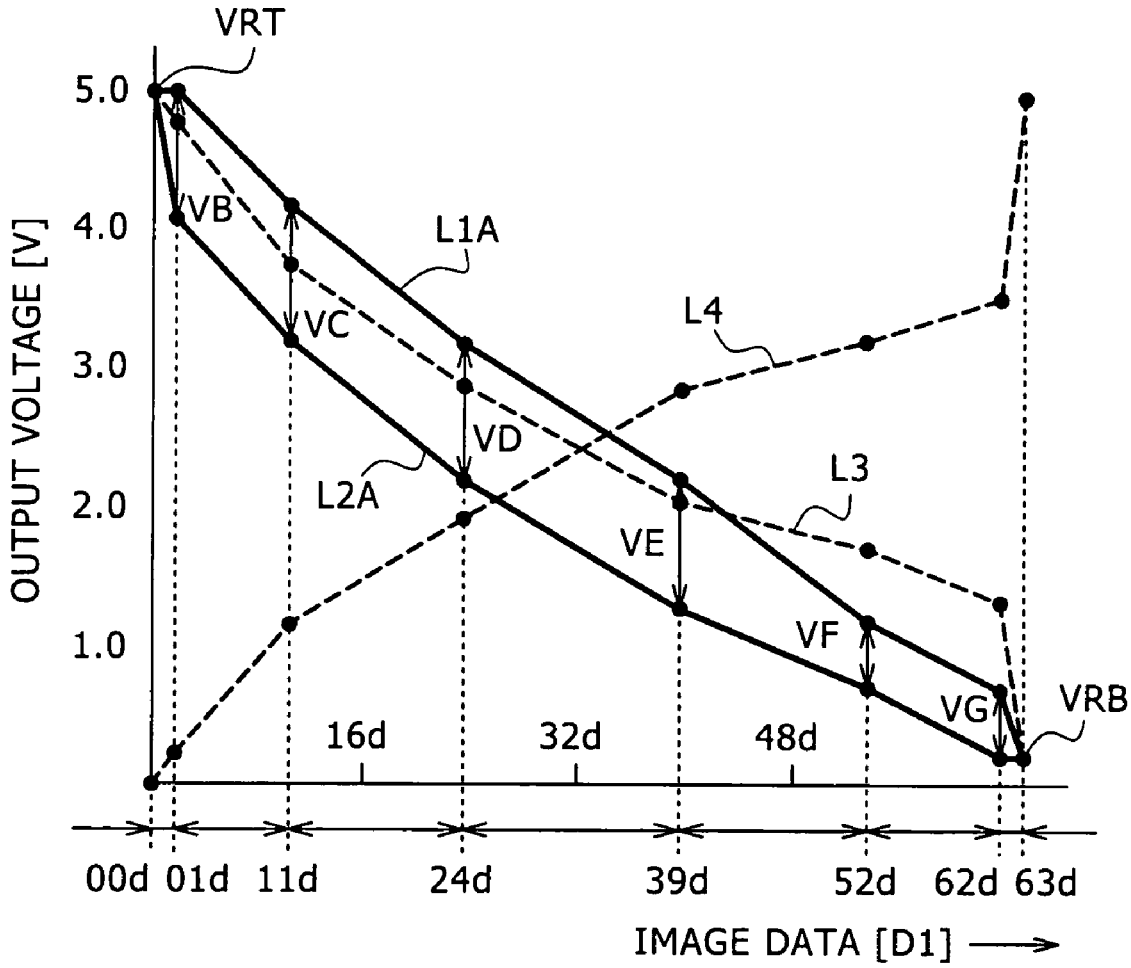
FIG. 7 is a characteristic curve diagram of assistance in explaining examples of setting of gamma characteristics in the PDA of FIG. 2.

FIG. 7 is a characteristic curve diagram showing examples of gamma characteristics thus realized. In the present embodiment, as compared with a characteristic curve indicated by a reference L1A, for example, a gamma characteristic can be varied by setting the original reference voltage setting data DV as indicated by a reference L2A. It is thus possible to display a desired image with a desired gamma characteristic. Also, the black level and the white level are set for each color and each product by setting the black level original reference voltage setting data DVVRT and the white level original reference voltage setting data DVVRB so as to deal with variations in characteristics of light emission in each color and of each product and changes in the light emission characteristics with the passage of time. Further, gamma characteristics of the liquid crystal display panel which characteristics are indicated by a reference L3 and a reference L4 can also be realized by storing two kinds of data in the memory 50 for correspondence with line reversal or selecting correction data D2 corresponding to line reversal.

Thus, in the present embodiment, the original reference voltage generating circuit 70 constitutes an original reference voltage generating circuit for generating a plurality of original reference voltages VRT, VB to VG, and VRB. The reference voltage generating circuit 69 constitutes a reference voltage generating circuit formed by connecting a plurality of voltage divider circuits R1 to R7 in series with each other, the voltage divider circuits each being formed by connecting a plurality of resistances in series with each other, the original reference voltages VRT, VB to VG, and VRB being inputted to both ends of the voltage divider circuits R1 to R7 and between the voltage divider circuits R1 to R7, and the reference voltage generating circuit outputting a plurality of reference voltages V1 to V64 as voltages divided by the plurality of voltage divider circuits R1 to R7. The digital-to-analog converter circuits 15A to 15N constitute a plurality of selecting circuits for outputting driving signals by receiving the plurality of reference voltages V1 to V64 and selecting and outputting the reference voltages V1 to V64 according to image data D1 for corresponding signal lines SIG. The decoder 75 constitutes an input circuit for inputting original reference voltage setting data DV for specifying settings of the original reference voltages. The digital-to-analog converter circuits 71A to 71H in the original reference voltage generating circuit 70 constitute a plurality of digital-to-analog converter circuits for generating the original reference voltages VRT, VB to VG, and VRB by generating a plurality of candidate voltages for the original reference voltages VRT, VB to VG, and VRB by voltage divider circuits 72A and 72H for generating the original reference voltages and selecting and outputting the candidate voltages according to the original reference voltage setting data DV. The digital-to-analog converter circuit 71A of the digital-to-analog converter circuits divides a reference voltage generating voltage VCOM by the original reference voltage generating voltage divider circuit 72A, and outputs the first original reference voltage VRT among the plurality of original reference voltages VRT, VB to VG, and VRB. The digital-to-analog converter circuit 71H divides the reference voltage generating voltage VCOM by the original reference voltage generating voltage divider circuit 72H, and outputs the second original reference voltage VRB among the plurality of original reference voltages VRT, VB to VG, and VRB. The original reference voltage generating voltage divider circuits 72B to 72G of the other digital-to-analog converter circuits 71B to 71G are connected in series with each other, and the first original reference voltage VRT and the second original reference voltage VRB are input to both ends of the original reference voltage generating voltage divider circuits 72B to 72G.

The memory control circuit 59 and the memory 60 constitute a time division multiplexing circuit for time-division-multiplexing image data for pixels of each color such that image data for pixels of a same color is contiguous in a line unit, and inputting the time-division-multiplexed image data to a horizontal driving circuit. The original reference voltage setting circuit 63 constitutes a data changing circuit for changing the original reference voltage setting data DV so as to correspond to changing of color of the time-division-multiplexed image data. The selectors 17A to 17N constitute a selecting circuit for changing output of the driving signals so as to correspond to the changing of the color of the image data.

(2) Operation of Embodiment

In the above-described configuration of the PDA 41 (FIG. 2), image data DR to DB used for display are input from the apparatus main unit 42 to the controller 47. The controller 47 subjects the image data DR to DB to a time-division-multiplexing process via the memory 60 such that image data for a same color are contiguous in a line unit, and it inputs image data D1 as a result of the process to the horizontal driving circuit 55. In the horizontal driving circuit 55, the image data D1 is captured into the shift register 13, and then image data for the same color is input into the digital-to-analog converter circuits 15A to 15N in parallel in a line unit. The image data is converted into driving signals by a digital-to-analog conversion process in the digital-to-analog converter circuits 15A to 15N. The driving signals are input to the selectors 17A to 17N via the amplifier circuits 16A to 16N, respectively. Thus the image data D1 is distributed to combinations of red, green, and blue pixels among pixels formed by organic EL elements repeated sequentially and cyclically in the horizontal direction in order of red, green, and blue in the display unit 44. The image data D1 is thereafter converted into driving signals. The driving signals are distributed to signal lines SIG for red, green, or blue pixels by the selectors 17A to 17N. Thus the PDA 41 sets a gradation level of each pixel by the image data DR to DB, and thereby displays a desired image.

The original reference voltage generating circuit 70 (FIG. 1) generates a plurality of original reference voltages VRT, VB to VG, and VRB. The reference voltage generating circuit 69 as a resistance series circuit formed by connecting a plurality of voltage divider circuits R1 to R7 in series with each other, the voltage divider circuits being each formed by connecting a predetermined number of resistances in series with each other, forms reference voltages V1 to V64 by dividing the original reference voltages VRT, VB to VG, and VRB. The digital-to-analog converter circuits 15A to 15N perform digital-to-analog conversion processing on the image data D1 by selecting the reference voltages V1 to V64, and thereby generate driving signals. Thus the driving signals are generated on the basis of a gamma characteristic obtained by line graph approximations set by the original reference voltages VRT, VB to VG, and VRB, and then an image is displayed.

With the organic EL elements, since light emission characteristics differ for each color and each product, and also the light emission characteristics change with the passage of time, in order to thus generate the driving signals by subjecting the image data DR to DB to the digital-to-analog conversion process, the reference voltages V1 to V64 based on the thus-set gamma characteristic need to be set for each color and each product, and corrected so as to deal with the change with the passage of time.

Hence, the light emission characteristics of the PDA 41 are measured for each color and each product, and original reference voltage setting data DV specifying settings of the original reference voltages VRT, VB to VG, and VRB is recorded and retained in the memory 50 (FIG. 2) so as to be able to secure a desired light emission characteristic on the basis of a result of the measurement. Also, correction data D2 for correcting the black level original reference voltage VRT and the white level original reference voltage VRB among the original reference voltages VRT, VB to VG, and VRB is recorded in the memory 45. The original reference voltage setting circuit 63 in the PDA 41 corrects the original reference voltage setting data DV by the correction data D2. Then, the original reference voltage setting circuit 63 sequentially inputs the corrected original reference voltage setting data DV to the horizontal driving circuit 55 in such a manner as to correspond to time-division-multiplexing for the image data D1.

The decoder 75 in the horizontal driving circuit 55 (FIG. 1) divides the original reference voltage setting data DV into pieces of data for the original reference voltages VRT, VB to VG, and VRB. These pieces of original reference voltage setting data DV are subjected to digital-to-analog conversion processing by the digital-to-analog converter circuits 71A to 71H, whereby the original reference voltages VRT, VB to VG, and VRB are generated.

Thus, the present embodiment can deal with various light emission characteristics by the setting of the original reference voltage setting data DV. It is therefore possible to deal with various display panels readily and quickly. That is, since dynamic range adjustment and black level adjustment can be made and the gamma characteristic can be varied by simply changing the data, it is possible to shorten a development period greatly as compared with the related-art and further to reduce the time and labor required for development.

In addition, it is thereby possible to deal flexibly with variations in the light emission characteristics for each color and each product and change in the light emission characteristics with the passage of time, thus effectively avoiding such variations in the characteristics, and a shift in white balance and a degradation in color reproducibility due to the change with the passage of time to provide high-quality display images.

Thus light emission characteristics can be corrected in various manners by setting the original reference voltages VRT, VB to VG, and VRB on the basis of the original reference voltage setting data DV. In the PDA 41, the digital-to-analog converter circuits 71A and 71H for the black level original reference voltage VRT and the white level original reference voltage VRB divide the reference voltage generating voltage VCOM by the voltage divider circuits 72A and 72H, generate a plurality of candidate voltages for the original reference voltages VRT and VRB, respectively, select the plurality of candidate voltages according to the original reference voltage setting data DV, and thereby generate the original reference voltages VRT and VRB. Thus the original reference voltages VRT and VRB can be set variously between the reference voltage generating voltage VCOM and a ground potential.

On the other hand, in the digital-to-analog converter circuits 71B to 71G for the other original reference voltages VB to VG, the voltage divider circuits 72B to 72G are connected in series with each other, and both ends of the voltage divider circuits 72B to 72G are connected to the black level original reference voltage VRT and the white level original reference voltage VRB. In this state, the voltage divider circuits 72B to 72G generate a plurality of candidate voltages for the original reference voltages VB to VG, respectively, by voltage division, and the plurality of candidate voltages are selected according to the original reference voltage setting data DV, whereby the original reference voltages VB to VG are generated.

Hence, the original reference voltages VB to VG are maintained so as to be varied only in a range of the candidate voltages output respectively, from the voltage divider circuits 72B to 72G connected in series with each other. Thus, even when the original reference voltage setting data DV is erroneously set due to the mixing in of noise, the PDA 41 can prevent output of driving signals with an extreme gamma characteristic and thereby prevent significant degradation in image quality due to the noise.

In addition, since both ends of the voltage divider circuits 72B to 72G thus connected in series with each other are connected to the black level original reference voltage VRT and the white level original reference voltage VRB, when the original reference voltages VRT and VRB are changed to correct variations in light emission characteristics and changes with the passage of time by dynamic range adjustment and black level adjustment, the original reference voltages VB to VG also change so as to follow the change in the original reference voltages VRT and VRB by resistance voltage division ratios of the voltage divider circuits 72B to 72G connected in series with each other. It is therefore possible to omit a process of resetting the original reference voltages VB to VG and thus simplify an adjustment operation by omitting a calculation process for these other digital-to-analog converter circuits 71B to 71G in the PDA 41.

Further, by thus setting the original reference voltages VRT, VB to VG, and VRB according to the original reference voltage setting data DV and changing the original reference voltage setting data DV so as to correspond to the time-division-multiplexing process for transmission of the image data D1, it is possible to share one system of the original reference voltage generating circuit to process image data for each color and thereby simplify a configuration as a whole.

The PDA 41 outputs the original reference voltage setting data DV to change the gamma characteristic three times in all for one line. Therefore, even when the gamma characteristic is erroneously set due to the mixing in of noise, the erroneous setting of the gamma characteristic due to the effect of the noise can be limited to one line, which also can reduce a degradation in image quality due to the noise.

In the PDA 41, the original reference voltages VRT, VB to VG, and VRB are thus set according to the original reference voltage setting data DV, and the original reference voltage generating circuit for generating the original reference voltages VRT, VB to VG, and VRB is disposed on the reference voltage generating circuit side so that the original reference voltage generating circuit and the reference voltage generating circuit are formed integrally with each other in an integrated circuit. Thus amplifier circuits used for input of the original reference voltages VRT, VB to VG, and VRB can be omitted in the reference voltage generating circuit 69. Therefore, it is possible to correspondingly simplify the configuration and reduce power consumption. In addition, since the amplifier circuits are not required, accuracy of the original reference voltages VRT, VB to VG, and VRB input to the reference voltage generating circuit can be correspondingly improved. It is thereby possible to improve accuracy in setting the reference voltages V1 to V64, and thus improve productivity.

(3) Effects of Embodiment

According to the above-described configuration, original reference voltages are generated by selecting a plurality of candidate voltages formed by voltage divider circuits according to original reference voltage setting data. Reference voltages for digital-to-analog conversion are generated from the original reference voltages. The original reference voltages at both ends are generated by dividing a reference voltage generating voltage by the voltage divider circuit. The other original reference voltages are generated with voltage divider circuits connected in series with each other and the original reference voltages at both ends used as a reference. It is thereby possible to correct light emission characteristics variously, effectively avoid significant degradation in image quality due to noise, and simplify an adjustment operation.

In addition, by forming the original reference voltage generating circuit and the reference voltage generating circuit integrally with each other in an integrated circuit together with the other configuration, it is possible to omit amplifier circuits used for input of the original reference voltages, correspondingly simplify the configuration as compared with the related-art one, and further reduce power consumption.

In addition, by time-division-multiplexing image data such that image data for pixels of the same color are contiguous in a line unit so as to correspond to the repetition of pixels in the display unit and then transmitting the time-division-multiplexed image data to drive the display unit, and by changing the original reference voltages according to the original reference voltage setting data so as to correspond to the changing of the image data in the time-division-multiplexing, it is possible to further reduce degradation in image quality due to the mixing in of noise.

Further, by correcting the original reference voltage setting data by correction data, it is possible to reliably correct a change in light emission characteristics with the passage of time.

It is to be noted that while in the foregoing embodiment a description has been made of a case where the present invention is applied to a PDA, the present invention is not limited to this, and is widely applicable to various image apparatuses.

The present invention relates to a driving circuit of a flat display device and a flat display device, and it is, for example, applicable to a display device using organic EL elements.

What is claimed is:

1. A driving circuit of a flat display device, said driving circuit generating driving signals by subjecting image data to digital-to-analog conversion processing, and driving signal lines of a display unit formed by arranging pixels in a form of a matrix by said driving signals, said driving circuit comprising:

an original reference voltage generating circuit for generating a plurality of original reference voltages;

a reference voltage generating circuit formed by connecting a plurality of voltage divider circuits in series with each other, said voltage divider circuits each being formed by connecting a plurality of resistances in series with each other, said original reference voltages being inputted to both ends of said voltage divider circuits and between said voltage divider circuits, respectively, said reference voltage generating circuit outputting a plurality of reference voltages as voltages divided by said plurality of voltage divider circuits;

a plurality of selecting circuits for outputting said driving signals by receiving said plurality of reference voltages and selecting and outputting the reference voltages according to said image data for corresponding signal lines; and an input circuit for inputting original reference voltage setting data for specifying settings of said original reference voltages;

wherein said original reference voltage generating circuit includes a plurality of digital-to-analog converter circuits for generating said original reference voltages by generating a plurality of candidate voltages for said original reference voltages by voltage divider circuits for generating the original reference voltages and selecting and outputting the candidate voltages according to said original reference voltage setting data; and a first digital-to-analog converter circuit of said plurality of digital-to-analog converter circuits divides a reference voltage generating voltage by a voltage divider circuit for generating said original reference voltage, and outputs a first original reference voltage of said plurality of original reference voltages;

a second digital-to-analog converter circuit of said plurality of digital-to-analog converter circuits divides said reference voltage generating voltage by a voltage divider circuit for generating said original reference voltage, and outputs a second original reference voltage of said plurality of original reference voltages; and voltage divider circuits for generating said original reference voltages of the other digital-to-analog converter circuits of said plurality of digital-to-analog converter circuits are connected in series with each other, and said first original reference voltage and said second original reference voltage are input to both ends, respectively, of the other digital-to-analog converter circuits.

2. A driving circuit of a flat display device as claimed in claim 1, wherein said original reference voltage generating circuit, said reference voltage generating circuit, said selecting circuits, and said input circuit are formed integrally with each other in an integrated circuit.

3. A driving circuit of a flat display device as claimed in claim 1, wherein image data for said pixels of each color is time-division-multiplexed and input such that image data for said pixels of a same said color is contiguous in a line unit; and said original reference voltage generating circuit changes said original reference voltages so as to correspond to the changing of color of said time-division-multiplexed and input said image data.

4. A flat display device for displaying an image on a basis of image data, said flat display device comprising:

a display unit formed by arranging pixels in a form of a matrix; and a horizontal driving circuit for driving signal lines of said display unit by driving signals;

wherein said horizontal driving circuit includes:

an original reference voltage generating circuit for generating a plurality of original reference voltages;

a reference voltage generating circuit formed by connecting a plurality of voltage divider circuits in series with each other, said voltage divider circuits each being formed by connecting a plurality of resistances in series with each other, said original reference voltages being inputted to both ends of said voltage divider circuits and between said voltage divider circuits, respectively, said reference voltage generating circuit outputting a plurality of reference voltages as voltages divided by said plurality of voltage divider circuits; and a plurality of selecting circuits for outputting said driving signals by receiving said plurality of reference voltages and selecting and outputting the reference voltages according to said image data for corresponding signal lines, and wherein said original reference voltage generating circuit includes a plurality of digital-to-analog converter circuits for generating said original reference voltages by generating a plurality of candidate voltages for said original reference voltages by voltage divider circuits for generating the original reference voltages and selecting and outputting the candidate voltages according to original reference voltage setting data, a first digital-to-analog converter circuit of said plurality of digital-to-analog converter circuits dividing a reference voltage generating voltage by a voltage divider circuit for generating said original reference voltage, and outputting a first original reference voltage, a second digital-to-analog converter circuit of said plurality of digital-to-analog converter circuits dividing said reference voltage generating voltage by a voltage divider circuit for generating said original reference voltage, and outputting a second original reference voltage, voltage divider circuits for generating said original reference voltages of the other digital-to-analog converter circuits of said plurality of digital-to-analog converter circuits being connected in series with each other, and said first original reference voltage and said second original reference voltage being input to both ends, respectively, of the other digital-to-analog converter circuits.

5. A flat display device as claimed in claim 4, further comprising:

a time-division-multiplexing circuit for time-division-multiplexing image data for said pixels of each color such that image data for said pixels of a same said color is contiguous in a line unit, and inputting the time-division-multiplexed image data to said horizontal driving circuit; and a data changing circuit for changing said original reference voltage setting data so as to correspond to the changing of color of said time-division-multiplexed image data;

wherein said horizontal driving circuit further includes a selecting circuit for changing the output of said driving signals so as to correspond to the changing of the color of said image data.

6. A flat display device as claimed in claim 5, wherein said data changing circuit generates said original reference voltage setting data by correcting said original reference voltage setting data by correction data for correcting a change in said display unit with the passage of time.

* * * * *